United States Patent [19]

Nelson

[11] 4,361,246

[45] Nov. 30, 1982

[54] CONTAINER CONSTRUCTION

[76] Inventor: Alexander Nelson, 606 E. Juneau Ave., Milwaukee, Wis. 53202

[21] Appl. No.: 217,252

[22] Filed: Dec. 17, 1980

[51] Int. Cl.[3] ..... B65D 8/00; B65D 8/18

[52] U.S. Cl. ..... 220/67; 220/66; 413/6; 413/31

[58] Field of Search ..... 220/66, 67, 1 BC; 229/5.5, 5.6; 413/31, 6

[56] References Cited

U.S. PATENT DOCUMENTS

| | | | |
|---|---|---|---|
| 3,441,170 | 4/1969 | Khoury | 220/66 X |
| 4,055,271 | 10/1977 | Kronenweller | 220/67 X |
| 4,093,102 | 6/1978 | Kraska | 220/67 |
| 4,165,011 | 8/1979 | Holk, Jr. | 220/67 |
| 4,254,886 | 3/1981 | Van Doren | 220/67 X |

FOREIGN PATENT DOCUMENTS

| | | | |
|---|---|---|---|
| 241333 | 7/1965 | Austria | 220/66 |
| 623368 | 7/1961 | Canada | 220/67 |
| 62759 | 9/1944 | Denmark | 220/66 |
| 76336 | 8/1961 | France | 220/67 |

*Primary Examiner*—Allan N. Shoap

*Attorney, Agent, or Firm*—Andrus, Sceales, Starke & Sawall

[57] ABSTRACT

A container having a cylindrical body and a pair of end panels includes a single seam construction for sealingly connecting the end panels to the body. Each end panel includes an integral upright flange which is curled outwardly at its free end for receiving the terminal end of the container body so that the outer surface of the flange intimately engages the outer surface of the body. The seam is then constructed by deforming the flange and container body inwardly and then outwardly so that the terminal end of the flange abuts the outer surface of the container body.

4 Claims, 7 Drawing Figures

CONTAINER CONSTRUCTION

BACKGROUND OF THE INVENTION

The existent containers for any kind of tinned food have construction defects. The principal construction defect which the existent containers have is the construction complexity of the double seam. Another construction defect which the existent containers have is the complication of the manufacturing of the containers with the double seam. The next construction defect which the existent containers have is the unnecessary consumption of a metal for the production of the containers with the double seam.

BRIEF SUMMARY OF THE INVENTION

This invention provides an improvement in the container construction which is particularly adapted to contain products of the character mentioned above and which is of simple and economical construction and may be manufacturing with optimum economy using a minimum amount of structural materials. While researching the present invention, these were the goals that I formulated: 1. To simplify the method of the manufacturing of the container. 2. To reduce the consumption of the metal for the manufacturing of the container end panel. 3. To simplify the process of the manufacturing of the container. All the foregoing problems were solved completely.

DESCRIPTION OF THE DRAWINGS

The above and other objects and advantages of the present invention will be more fully understood and appreciated with reference to the following description and drawings appended thereto in which.

DESCRIPTION OF THE PREFERRED EMBODIMENT

Figure 1:
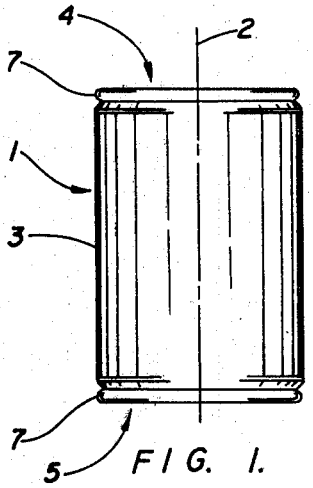
FIG. 1 is a side elevation of one exemplary embodiment of the container construction of this invention.
Figure 2:
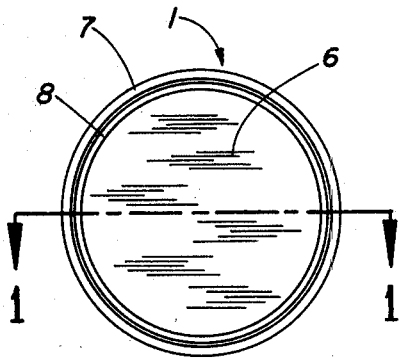
FIG. 2 is a top plan view of the container construction of FIG. 1.
Figure 3:
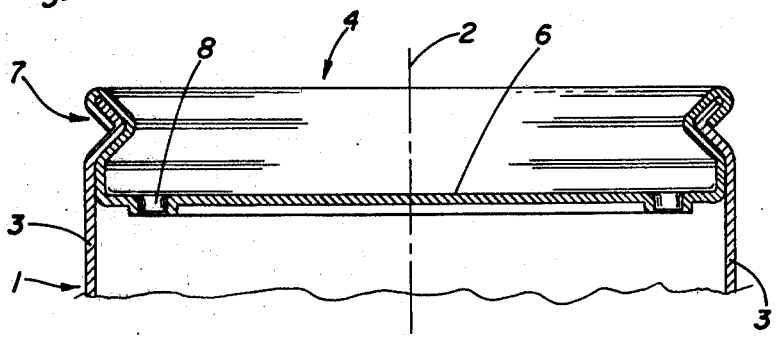
FIG. 3 is a fragmentary cross-sectional view drawn to an enalarged scale and taken on the line 1—1 of FIG. 2.

Referring now to the drawings and more particularly to FIGS. 1–4, the container 1 has a central longitudinal axis 2 and comprises a body having an elongated cylindrical side wall 3 of uniform diameter, an upper end 4 and a lower end 5. The upper end 4 includes a container end panel 6, a manual opening device 8 and a single seam 7. The lower end 5 also includes a container end panel and a single seam (not shown) identical to the seam 7.

The upper end 4 of the container 1 is closed or sealed by means of the container end panel 6. The container end panel 6 is secured to the cylindrical side wall 3 by means of the single seam 7, which is formed in accordance with this invention. The container end panel 6 may include any kind of manual opening device 8. The lower end 5 of the container 1 is closed or sealed by means of a second container end panel. The second end panel is secured to the cylindrical side wall 3 by means of a single seam identical to seam 7, which is also formed in accordance with this invention.

Figure 4:
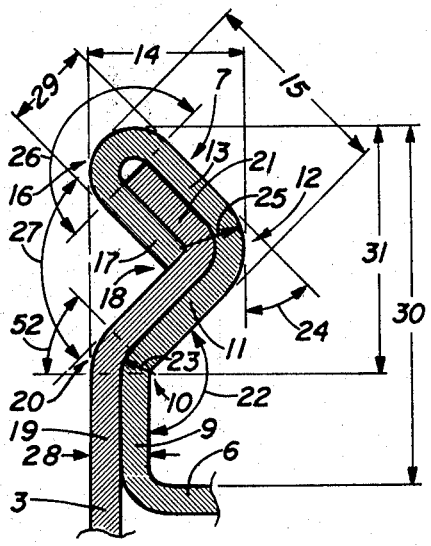
FIG. 4 is an enlarged detail section of a portion of the container of FIG. 3.

As seen particularly in FIG. 4, the single seam 7 is made of the cylindrical side wall 3 and the container end panel 6. The single seam 7 has the first vertical wall 9, the first outward rounded shoulder 10, the first sloping wall 11, the first inner rounded shoulder 12, the second sloping wall 13, the semi-annular shoulder 16, the third sloping wall 17, the outward angle shoulder 18, the second vertical wall 19, the outward convex bead 20 and the L-shaped bead 21.

The first vertical wall 9 adjoins the container end panel 6 and the first outward rounded shoulder 10. The first vertical wall 9 parallels the longitudinal axis 2. The first sloping wall 11 adjoins the first outward rounded shoulder 10 and the first inner rounded shoulder 12. The first sloping wall 11 is arranged at an angle 22 with the longitudinal axis 2. The angle 22 may range between 134 and 136 degrees with the longitudinal axis 2. The first outward rounded shoulder 10 has a radius 23 which may range between 0.0116–0.0120 inch. The second sloping wall 13 adjoins the first inner rounded shoulder 12 and the semi-annular shoulder 16. The second sloping wall 13 is arranged at an angle 24 with the longitudinal axis 2. The angle 24 ranging between 44 and 46 degrees with the longitudinal axis 2. The first inner rounded shoulder 12 has a radius 25 which may range between 0.0214–0.0218 inch. The semi-annular shoulder 16 has a substantial arcuate length, when viewed in cross section, indicated 26 which is 180 degrees. The third sloping wall 17 adjoins the semi-annular shoulder 16 and the outward angle shoulder 18 and paralleling the second sloping wall 13. The outward angle shoulder 18 has an angle 27. The angle 27 ranging between 89 and 91 degrees. The second vertical wall 19 adjoins the first vertical wall 9 and the outward convex bead 20. The second vertical wall 19 parallels the longitudinal axis 2. The outward convex bead 20 has a substantial arcuate length, when viewed in cross section, indicated at 52 which has an angle ranging between 44 and 46 degrees. The L-shaped bead 21 adjoins the outward convex bead 20 and the semi-annular shoulder 16. The thickness of the vertical walls 9 and 19 of the single seam 7 indicated at 28 which may be 0.0193 inch plus or minus 0.0004 inch. The thickness of the semi-annular shoulder 16 indicated at 29 which may be 0.0291 inch plus or minus 0.0004 inch. The overall height of the single seam 7 indicated at 30 which may be 0.118 inch plus or minus 0.004 inch. The L-shaped configuration of the single seam 7 has the overall height indicated at 31 which may be 0.081 inch plus or minus 0.004 inch and the first overall width indicated at 14 which may be 0.051 inch plus or minus 0.004 inch and also the second overall width indicated at 15 which may be 0.062 inch plus or minus 0.004 inch.

The L-shaped configuration of the single seam 7 improves the capability to withstand internal pressure and provides rigidity, impermeability, tensile strength and reliability for the seal at the top of the container.

Figure 5:
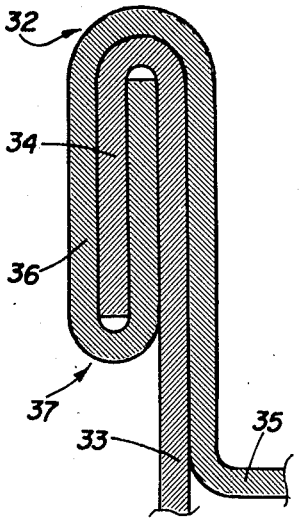
FIG. 5. PRIOR ART
FIG. 5 is an enlarged detail section of a typical double seam employed in many prior art containers.

By comparison with the existent double seam 32 such as seen in FIG. 5, the single seam 7 of this invention has advantages in conservation of structureal material. In the end the consumption of metal for the single seam 7 amounts to 50% by comparison with the consumption of metal for the double seam 32.

FIG. 5 is a fragmentary cross-sectional view of the existent double seam 32 to an enlarged scale. The existent double seam 32 has the upper end of a cylindrical container wall 33 which is deformed outwardly and downwardly to define a downwardly opening U-shaped flange 34. The can end 35 is curled to define an attaching flange or bead 36 which embraces the U-shaped flange 34 and which terminates within the U-shaped flange. The bead 36 defines a downwardly facing annular shoulder 37.

Figure 6:
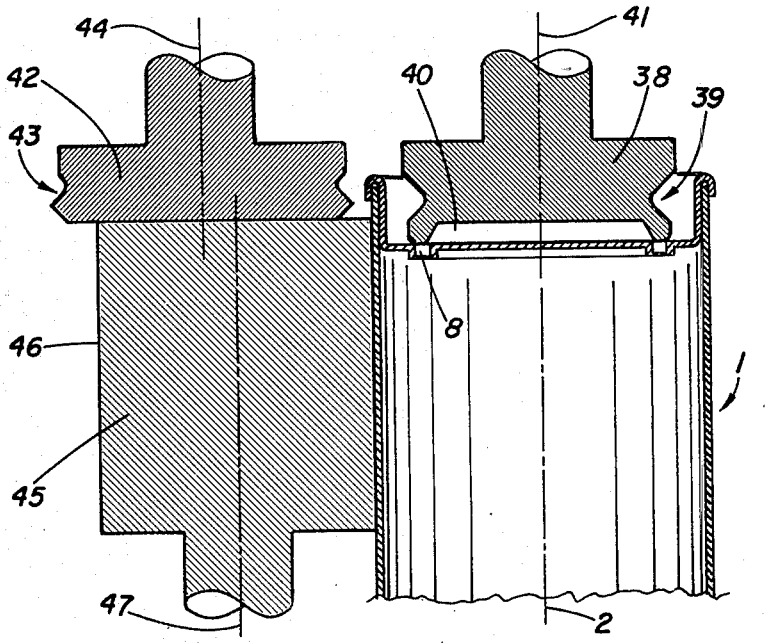
FIG. 6 is a view illustrating a preparatory stage of the production of the single seam in the container construction of this invention.

FIG. 6 is a view illustrating a preparatory stage of the production of the single seam.

The first movable turning fixture 38 and the second movable turning fixture 42 define the outline or configuration of the single seam 7. The first movable turning fixture 38 has an outside surface 39, an inner cylindrical space 40 and an axis of rotation 41. The outside surface 39 of the first fixture 38 has the same configuration as the inner surface of the single seam 7. The inner cylindrcial space 40 serves for the presence of any kind of manual opening device 8 for the container 1. The second movable turning fixture 42 has an outside surface 43 and an axis of rotation 44. An outside surface 43 of the second fixture 42 has the same configuration as the outside surface of the single seam 7. A turning fixture 45 has a cylindrical surface 46 and is rotatable on a fixed axis 47.

Figure 7:
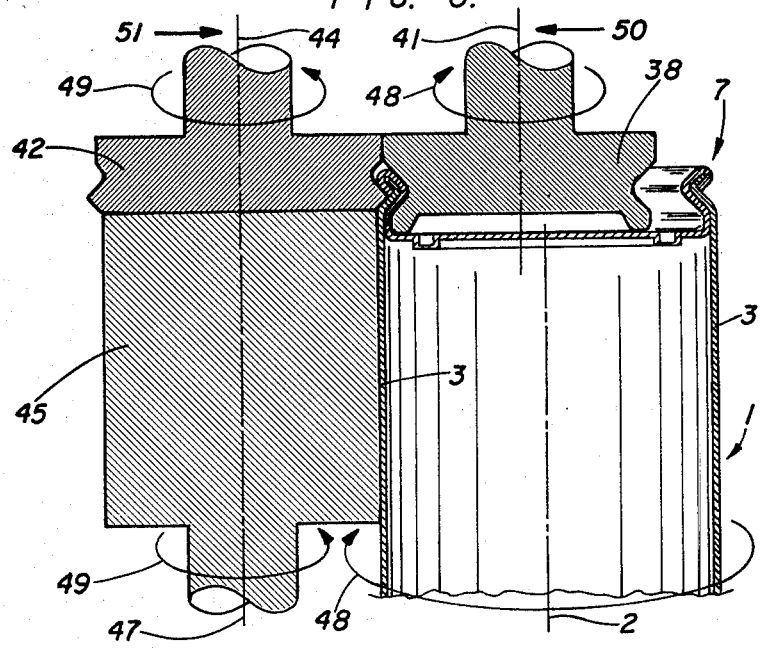
FIG. 7 is a view illustrating a principal stage of the production of the single seam in the container construction of this invention.

FIG. 7 is a view illustrating a principal stage of the production of the single seam 7. At this stage the first movable turning fixture 38 is moved in the direction of the arrow 50 and is turning in the way of an arrow 48. The cylindrical side wall 3 of the container 1 is turning in a way indicated by the arrow 48. At this stage the second movable turning fixture 42 is moved in the direction of arrow 51 and is turning in the opposite way indicated by arrow 49 with the same speed as the speed of the first movable turning fixture 38. At the same time the stationary turning fixture 45 is turning with the same speed as the speed of the second movable turning fixture 42 in the way indicated by the arrow 49.

While present exemplary embodiments of this invention, and methods of practicing the same, have been illustrated and described, it will be recognized that this invention may be otherwise variously embodied and practiced within the scope of the following claims.

What is claimed and desired to be secured by Letters Patent is:

1. A container, comprising a container body having an end portion defining an open end of said body, and closure means for closing said body open end, said closure means including a panel having an upright flange at the periphery of said panel which cooperates with the end portion of said body to define a single seam sealingly connecting the container body and panel to close said body open end, said single seam comprising:

a first vertically extending wall portion on the end portion of said container body;

a second wall portion extending upwardly and inwardly from the upper end of said first wall portion;

a third wall portion extending upwardly and outwardly from the upper end of said second wall portion;

first, second and third wall portions on the flange of said panel intimately overlying the inner surface of said body end portion and deformed to correspond respectively to the shapes of the first, second and third wall portions of said body end portion;

a fourth wall portion on the flange of said panel intimately overlying the outer surface of the third wall portion of said body end portion and extending parallel thereto, said fourth wall portion having a terminal surface disposed in abutting relation with the outer surface of the second wall portion of said body end portion; and an arcuate shoulder interconnecting the upper end of said fourth wall portion with the upper end of the third wall portion of said flange, said shoulder overlying the terminal end of the third wall portion of said body end portion and having an outer extremity lying within a vertical plane defined by the outer surface of the first wall portion of said body end portion.

2. The container of claim 1, wherein the second wall portion of said body end portion is disposed at an angle of about 135 degrees with respect to a vertical plane defined by the first wall portion of said body end portion.

3. The container of claim 1, wherein the third wall portion of said body end portion is disposed at an angle of about 90 degrees with respect to a plane defined by the second wall portion of said body end portion.

4. The container of claim 1, wherein the outer extremity of said arcuate shoulder is substantially tangent to the vertical plane defined by the outer surface of the first wall portion of said body end portion.

* * * * *